US008167392B2

(12) United States Patent
Sukigara

(10) Patent No.: US 8,167,392 B2
(45) Date of Patent: May 1, 2012

(54) INK JET RECORDING APPARATUS AND CONTROL METHOD THEREFOR

(75) Inventor: Akihiko Sukigara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 465 days.

(21) Appl. No.: 11/242,875

(22) Filed: Oct. 5, 2005

(65) Prior Publication Data

US 2006/0077216 A1 Apr. 13, 2006

(30) Foreign Application Priority Data

Oct. 8, 2004 (JP) ..... 2004-296765

(51) Int. Cl.
*B41J 2/195* (2006.01)
*B41J 29/38* (2006.01)
*B41J 29/393* (2006.01)

(52) U.S. Cl. ..... 347/7; 347/14; 347/19

(58) Field of Classification Search ..... 347/7, 14, 347/19

See application file for complete search history.

(56) References Cited

U.S. PATENT DOCUMENTS 4,887,167 A * 12/1989 Miura ..... 358/296
6,471,314 B2 * 10/2002 Doi ..... 347/5
6,529,692 B1 * 3/2003 Haines et al. ..... 399/27
6,547,355 B1 * 4/2003 Shimada et al. ..... 347/12
6,766,817 B2 7/2004 da Silva
2003/0025743 A1 * 2/2003 Maeda ..... 347/7
2003/0142591 A1 * 7/2003 Baweja et al. ..... 368/263
2005/0035985 A1 * 2/2005 Taguchi et al. ..... 347/7

FOREIGN PATENT DOCUMENTS

JP 11-119601 A 4/1999
JP 2003-320686 A 11/2003

* cited by examiner

*Primary Examiner* — Jason Uhlenhake
(74) *Attorney, Agent, or Firm* — Fitzpatrick, Cella, Harper & Scinto

(57) ABSTRACT

A user-friendly ink jet recording apparatus is capable of preventing a sudden ink exhaustion and a resulting unclear print that may result from canceling a no-ink error signal without an ink tank replacement. In the ink jet recording apparatus, in a case of a no-ink error signal, a no-ink timer is activated and time information of a no-ink state is stored in a non-volatile memory, a period from such time is measured and compared, and after the lapse of predetermined time, a no-ink error signal is generated even before a threshold value for the no-ink error signal is reached, thereby issuing a request for ink tank replacement to the user.

7 Claims, 7 Drawing Sheets

INK JET RECORDING APPARATUS AND CONTROL METHOD THEREFOR

BACKGROUND OF THE INVENTION

1. Field of the Invention

The present invention relates to an ink jet recording method and a control method therefor.

2. Related Background Art

In the prior art, a no-ink error signal in an ink jet recording apparatus is cancelled by an ink tank replacement, and, in case a same ink tank is used in continuation without the ink tank replacement, such no-ink error signal can be cancelled by an operation of a resume key or the like.

In case the no-ink error signal is cancelled by the resume key operation, a no-ink error signal of second time is generated with a threshold value same as that in the first-no-ink error signal.

There is also proposed a method of changing the threshold value to ½ and to ¼ in the second time and thereafter.

SUMMARY OF THE INVENTION

In such prior configuration, a user with a low frequency of use of the printer may forget that the no-ink error signal has been cancelled without replacing the ink tank. In case of use by plural users in a home, a next user does not know such history on the no-ink error signal. Therefore the user may encounter a situation where the ink is exhausted and the print becomes unclear without the no-ink error signal.

An object of the present invention is to provide a user-friendly ink jet recording apparatus capable of preventing a sudden ink exhaustion and a resulting unclear print by canceling the no-ink error signal without an ink tank replacement.

According to the present invention, when a no-ink state is reached, a no-ink timer is activated and time information when the no-ink state is reached is stored in a non-volatile memory. Then a lapse of a predetermined time is measured from the timing of storage of the time information, and, after the lapse of the predetermined time, an ink tank replacement is requested to the user even before a threshold value for the no-ink error signal is reached.

The present invention provides an effect of preventing a situation where the ink is abruptly exhausted to result in an unclear printing by canceling a no-ink error signal without an ink tank replacement.

In particular, in case a user who has cancelled a no-ink error signal had not executed an ink tank replacement, a no-ink situation can be immediately informed when another user uses a printer after the lapse of a long period.

DETAILED DESCRIPTION OF THE PREFERRED EMBODIMENTS

The present invention can be best realized by the following embodiments.

First Embodiment

Figure 1:
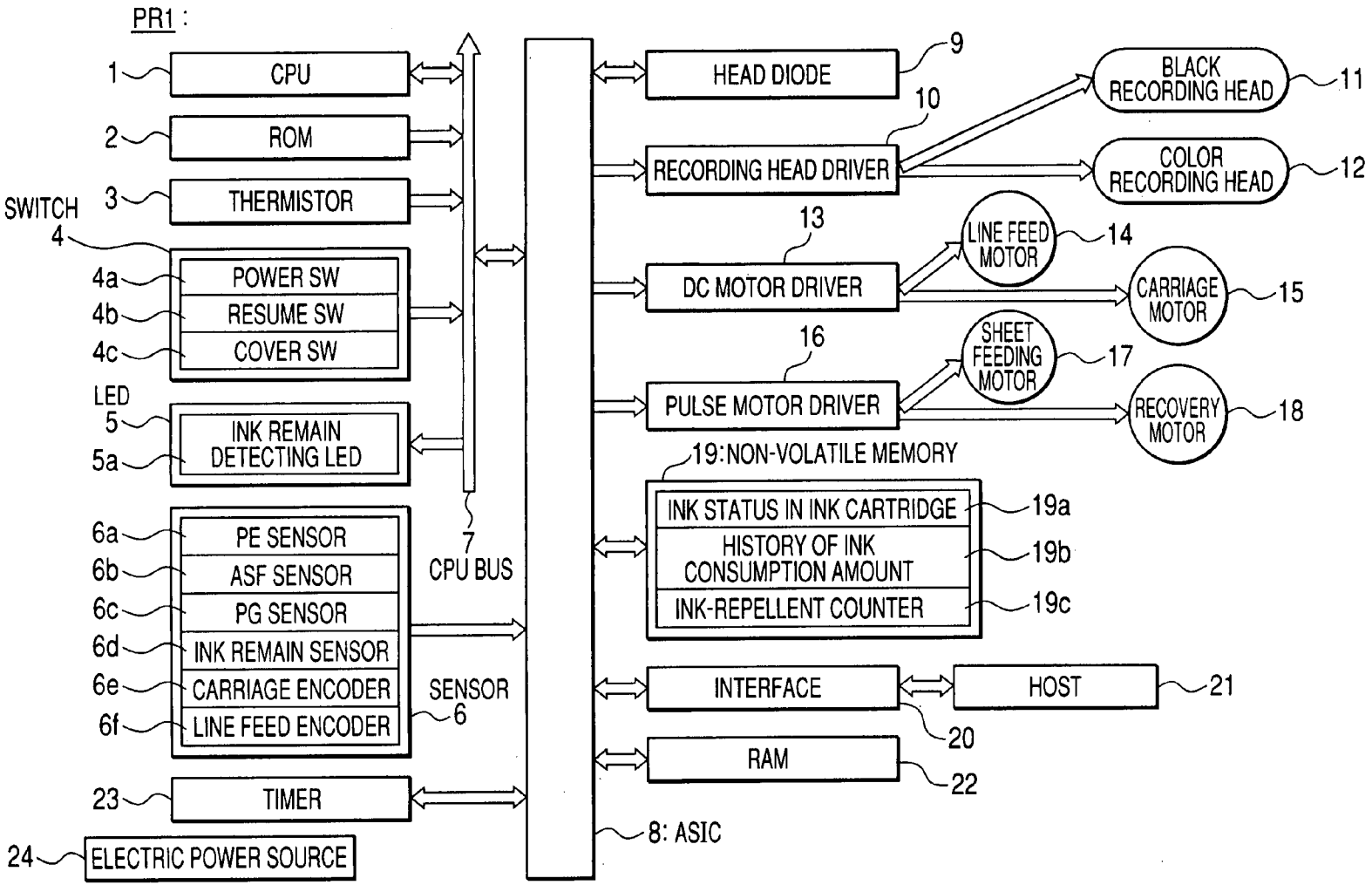
FIG. 1 is a block diagram showing an ink jet recording apparatus PR1 constituting a first embodiment of the present invention.

FIG. 1 is a block diagram showing an ink jet recording apparatus PR1 constituting a first embodiment of the present invention.

The ink jet recording apparatus PR1 is equipped with a CPU 1, a ROM 2, a switch 4, an LED 5, various sensors 6, a CPU bus 7, an ASIC 8, a recording head driver 10, a black recording head 11, a color recording head 12, a DC motor driver 13, a line feed motor 14, a carriage motor 15, a stepping motor driver 16, a recovery motor 18, a non-volatile memory 19, an interface 20, a host computer 21, a RAM 22, a timer 23, a power source 24, a carriage 30 and a conveying roller 33.

The CPU 1 is a central processing unit constituted as an example of a programmable microprocessor.

The ROM 2 stores font data, program instruction sequences to be executed by the CPU 1 for controlling the ink jet recording apparatus PR1, and various control tables.

The switch 4 includes switches to be operated by the user, such as a power switch 4*a* and a resume switch 4*b*.

The sensors 6 include a PE sensor (paper end sensor) 6*a*, an ASF sensor (sheet feeding sensor) 6*b*, a PG sensor (purge sensor) 6*c*, an ink remain sensor 6*d*, an encoder 6*e* and an encoder 6*f*.

The non-volatile memory 19 stores printer information such as an ink status 19*a* in an ink cartridge, an ink consumption history 19*b*, a used ink counter 19*c*' etc.

The RAM 22 stores, during an execution of a program stored in the ROM 2 by the CPU 1, various recording data transferred from the host computer 21 through an interface 20 in a print buffer in the RAM 22, in order to achieve a print output by the black recording head 11 and the color recording head 12.

The ASIC 8 is a control logic circuit which controls the recording head driver 10 in order to output control signals for nozzles in the recording heads 11, 12, also controls data transfer among the interface 20, the CPU 1 and the RAM 22, and is further provided with control logic circuits for the DC motor driver 13 and the stepping motor driver 16.

The CPU 1 is connected to the CPU bus 7. The interface 20 is provided with a signal path capable of bi-directional signal exchange between the ink jet recording apparatus PR1 and the host computer 21, and receives recording data and commands from the host computer 21.

The DC motor driver 13 controls the line feed motor 14 and the carriage motor 15. The line feed (LF) motor 14 drives the conveying roller 33, thereby controlling conveying and feed-discharge of a sheet. The carriage motor 15 drives a carriage 30 thereby controlling displacements of the recording heads 11, 12 to a recording position on a scanning row.

The stepping motor driver 16 controls the sheet feed motor 17 and the recovery motor 18. The sheet feed motor 17 controls a sheet pickup operation at a sheet feeding operation. The recovery motor 18 controls recovery operations such as cleaning, wiping, capping, etc., for the recording heads 11, 12.

The black recording head 11 and the color recording head 12, controlled by the recording head driver 10, are removable units displaced by the carriage. Such heads 11, 12 include an ink discharge nozzle for forming a recorded image on a recording medium, and a head diode 9 for feeding back information on the presence and characteristics of the removable recording head.

Based on an electrical signal transferred from the recording head driver 10, an electrothermal converting element of the recording head 11 or 12 is driven to generate thermal energy for causing a film boiling in the ink. As an ink discharge amount varies by a temperature of the recording head 11 or 12, a thermistor 3 for measuring an ambient temperature of the ink jet recording apparatus PR1 monitors a temperature output from the head diode 9 of the recording head 11, 12.

Various sensors 6 are mounted on the ink jet recording apparatus PR1. A PE sensor (pager end sensor) detects a passing sheet. An ASF sensor (sheet feed sensor) 6*b* detects a rotational position of a cam in a sheet feeding unit.

A PG sensor (purge sensor) 6*c* detects a cam position of a head recovery unit. An ink remain detecting sensor 6*d* is an optical sensor which detects presence/absence of ink in an ink tank, by an optical transmittance when the ink tank, supported on the carriage 30, passes over the sensor by a displacement of the carriage 30. In addition, there are also included a cover sensor linked with a cover switch 4*c*, an encoder 6*e* for reading positional information of the carriage, and an encoder 6*f* for reading positional information of the line feed (LF) motor.

There are also provided switches to be operated by the user, such as a power switch 4*a*, a resume switch 4*b*, etc. Also there is provided a display LED 5 for informing the user of a status of the ink jet recording apparatus PR1. An LED 5*a* is a light-emitting element used for detecting an ink remaining amount. The timer 23 is involved in controlling the motors, and the power source 24 supplies electric power for driving the ink jet recording apparatus PR1.

Figure 2:
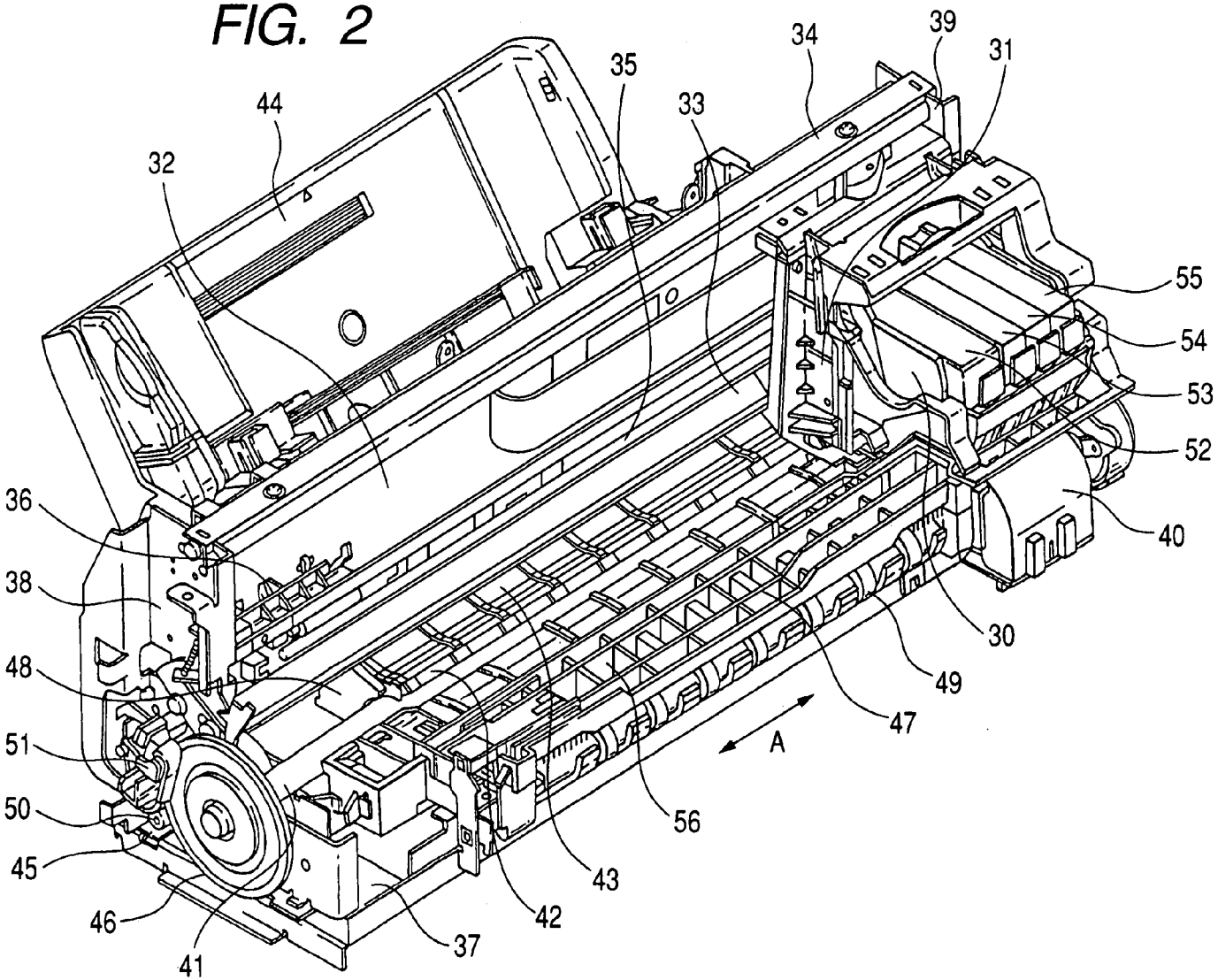
FIG. 2 is a perspective view, seen from a left side, of the entire ink jet recording apparatus PR1.

FIG. 2 is a perspective view of the entire ink jet recording apparatus PR1, seen from left side.

The ink jet recording apparatus PR1 is equipped with a recording head 30, a carriage 31, a chassis 32, a guide shaft 33, a guide rail 34, a timing belt 35, a carriage encoder 36, a base chassis 37, a left side plate 38, a right side plate 39, a recovery unit 40, a conveying roller 41, a pinch roller 42, a pinch roller holder 43, an automatic sheet feeder 44, a line feed encoder 46, a first sheet guide member 48, a position detector 51, sheet discharge rollers 49, a black ink tank 52, a cyan ink tank 53, a magenta ink tank 54, and a yellow ink tank 55.

The recording head 30 constitutes image recording means. The carriage 31 constitutes head mounting means for mounting the recording head 30. The guide shaft 33 serves as a guide member for guiding the carriage 31 in a direction A in FIG. 2, and also as a support means for supporting the carriage 31. A right hand side of the guide shaft 33 is positioned and fixed on the right side plate 39, and a left hand side of the guide shaft 33 is positioned and fixed on the left side plate 38.

The guide rail 34 is another guide/support member for guiding the carriage 31, thereby guiding the displacement thereof. A right hand side of the guide rail 34 is positioned on the right side plate 39, and a left hand side of the guide rail 34 is positioned on the left side plate 38.

A part of the timing belt 35 is fixed to the carriage 31. The carriage motor is positioned and fixed on the chassis 32. A drive of the carriage motor causes a scanning motion of the carriage 31, supporting the recording head 30, in a direction A in FIG. 2.

The carriage encoder 36 is a scale indicating an absolute position of the carriage 31 in the scanning direction, and constitutes position detecting means. A right hand side of the carriage encoder 36 is positioned and fixed on the right side plate 39, and a position of the carriage encoder 36 in height is restricted by the left side plate 38.

The recovery unit 40 executes a discharge recovery operation of the recording head 30. It includes an unillustrated cleaning means for cleaning a head face of the recording head 30, and an unillustrated cap means for forming a closed system on a discharge port portion of the recording head 30, and is positioned and fixed on the base chassis 37.

The conveying roller 41 is a sheet conveying rotary member (conveying means) for conveying a recording sheet as a recording medium. The pinch roller 42 maintains, by an unillustrated spring, the recording sheet in contact with the conveying roller 41. The pinch roller holder 43 rotatably supports the pinch roller 42.

The line feed encoder 46 is a scale for detecting a rotational position of the conveying roller 41, and is mounted on an end portion of the conveying roller 41. The position detector 51 is fixed on the left side plate 38, and detects a rotation amount of the conveying roller 41. The sheet discharge rollers 49 discharge the recording sheet to the exterior of the ink jet recording apparatus PR1.

The automatic sheet feeder 44 supports a stack of plural recording sheets, and separates and feeds a sheet at a time. The recording sheet fed by the automatic sheet feeder 44 is guided by the pinch roller holder 43 and the first sheet guide member 48, and is conveyed to a nip portion of the conveying roller 41 and the pinch roller 42. The first sheet guide member 48 is positioned and fixed, like the second sheet guide member, on the positioning portion of the base chassis 37.

The black ink tank 52, the cyan ink tank 53, the magenta ink tank 54 and the yellow ink tank 55 are mounted on the recording head 30, detachably from the recording head 30, and constitute ink reservoirs for discharging inks, designated by the host, onto the recording sheet.

Figure 3:
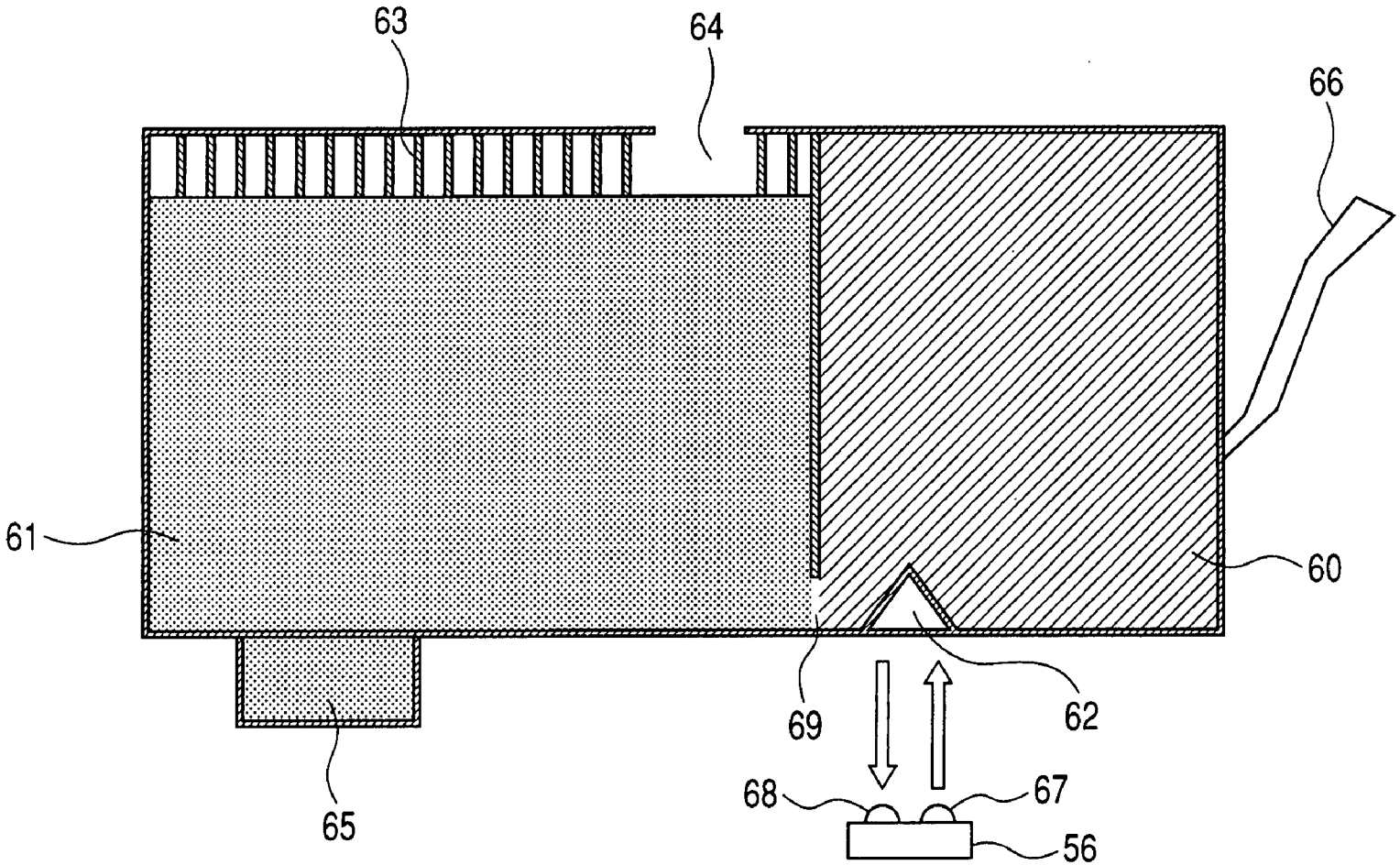
FIG. 3 is a cross-sectional view showing ink tanks 52, 53, 54, 55.

FIG. 3 is a cross-sectional view showing the inks tank 52, 53, 54 or 55.

The ink tank 52, 53, 54 or 55 for each color is provided, on an outside thereof, with an elastically deformable, integral lever member 66. Each color ink tank 52, 53, 54 or 55 communicates with the air in an upper part through a communicating aperture 64, and with an ink supply aperture 65 in a lower part, and includes therein a chamber 61 containing an absorbent member constituting a negative pressure generating member, and a substantially enclosed liquid chamber 60 for containing a liquid ink. The chambers 60 and 61 are separated by a partition.

The first chamber 60 and the second chamber 61 mutually communicate only through a communicating aperture 69 formed in the partition in the vicinity of the bottom of the ink tank. On an upper wall defining the first chamber 60, plural ribs 63 protruding inwardly are formed integrally. The absorbent member in the first chamber 61 is formed by a thermally compressed urethane foam, and is contained in a compressed state in order to generate a predetermined capillary force.

The ink remain detecting sensor unit 56 is provided with a light-emitting element 67 emitting an infrared light, and a photosensor element 68 capable of receiving the light from the light-emitting element 67. In each color ink tank, a light-reflecting prism 62 is provided integrally with the ink tank and is formed by an almost transparent material such as polypropylene. In the absence of ink on inclined top faces of the prism, the light from the light-emitting element 67 can be reflected and can reach the photosensor element 68. In a state where the ink is filled around the inclined top faces of the prism, the light from the light-emitting element 67 is less reflected to reduce the light amount reaching the photosensor element 68, whereby presence/absence of the ink can be detected.

An ink amount remaining in each of the color ink tanks 52, 53, 54, 55 can be detected by passing the carriage 31 over the ink remain detecting sensor unit 56.

Figure 4:
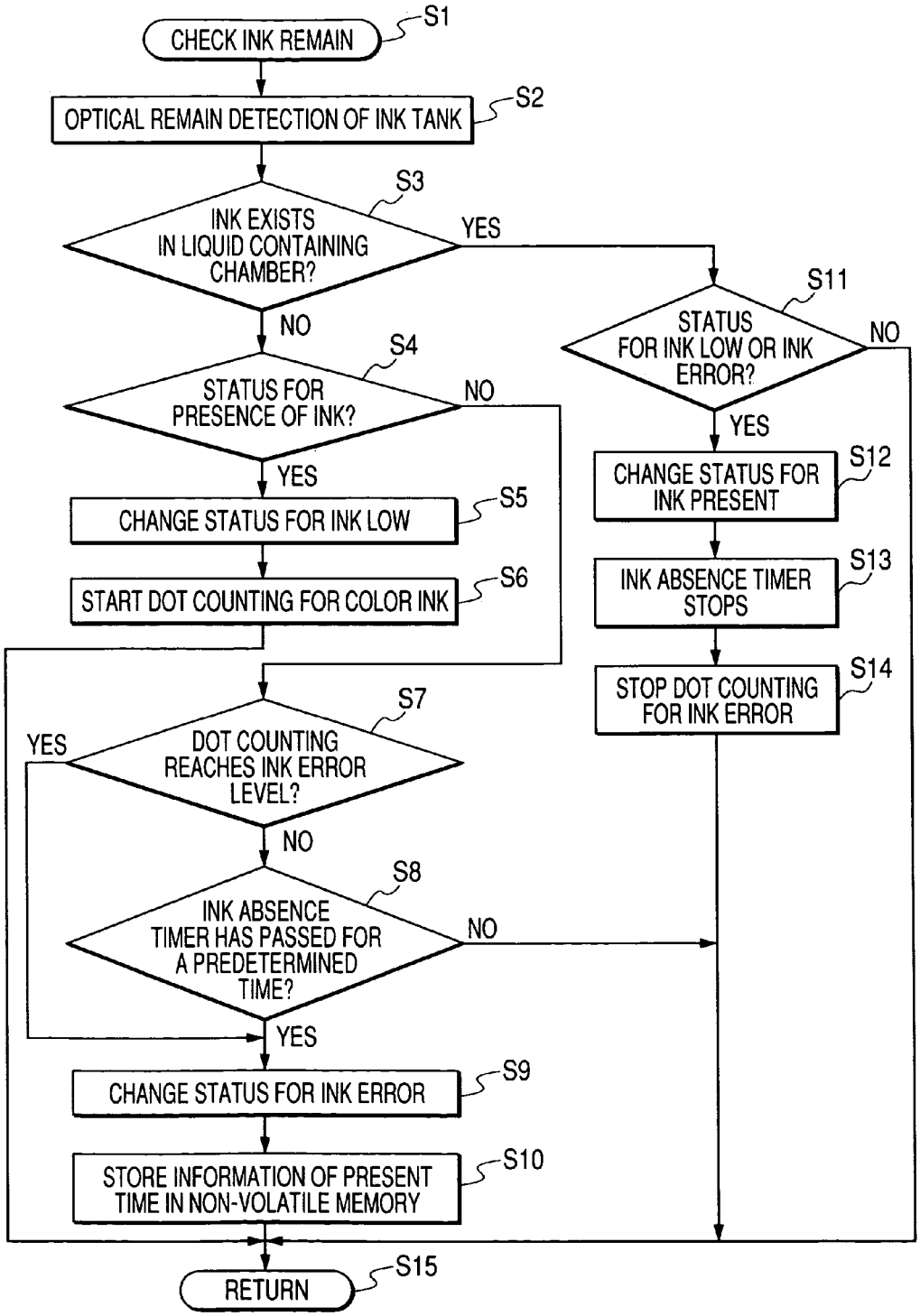
FIG. 4 is a flow chart showing an ink remain checking operation of the ink jet recording apparatus PR1.
Figure 5:
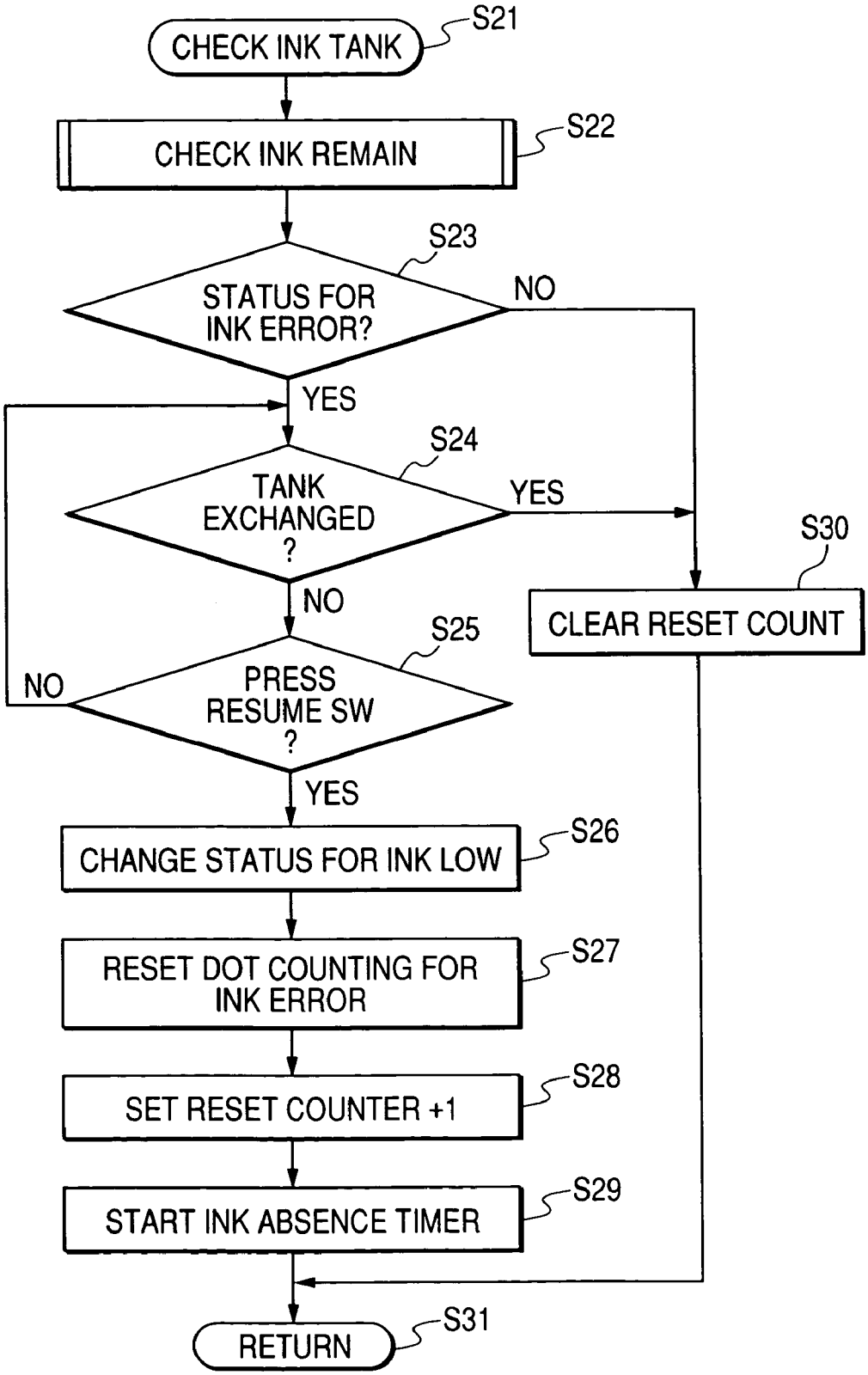
FIG. 5 is a flow chart showing an ink tank checking operation of the ink jet recording apparatus PR1.

FIG. 4 is a flow chart showing an ink remain checking operation in the ink jet recording apparatus PR1, showing details of S22 in FIG. 5.

A step S1 initiates an ink remain checking operation. In a step S2, when the carriage 31 passes over the ink remain detecting sensor unit 56, an optical remaining amount detection in the ink tank is executed by emitting an infrared light from the light-emitting element 67, receiving the light from the light-emitting element 67 by the photosensor element 68, thereby detecting an ink amount remaining in each color ink tank.

A step S3 checks whether the ink is present in the liquid chamber 60, and compares the result with the result of optical detection of the ink tank in S2. In case the ink is present in the liquid chamber 60, the sequence proceeds to S11. In case the ink is absent in the liquid chamber 60, a step S4 checks an ink status. The sequence proceeds to S7 unless the ink status indicates "ink present". In case the ink status is "ink present", a step S5 changes the ink status to "ink low". Then a step S6 starts a dot counting for ink error detection, and the sequence proceeds to S15.

A step S4 checks the ink status, and, in case the ink status is not "ink present", a step S7 checks whether the dot count for ink error started in S6 has reached an ink error level. Then a step S8 checks whether a no-ink timer has passed a predetermined time from a timing of a previous ink error. In case the predetermined time has not elapsed, the sequence returns to the main routine in S15 and continues the process. In case the no-ink timer has passed the predetermined time, the sequence proceeds to S9.

In case the dot count in S7 has reached the ink error level, the sequence proceeds to S9 to shift the ink status to "ink error". Then a step S10 stores the current time information, namely an ink error generation time information, in a non-volatile memory and executes an error notice and an error display, whereupon the sequence proceeds to S15.

The ink error generation time information, stored in the non-volatile memory, is maintained even when the power supply is turned off. The current time information is informed from the host to the no-ink timer, then renewed to latest information when the power supply is turned on, and is renewed thereafter in the printer.

In case S3 identifies that the ink is present in the liquid chamber 60, a step S11 checks whether the ink status is "ink low" or an ink error. In case neither state is found, the sequence proceeds to S15 to continue the process. On the other hand, in case the ink status is "ink low" or an ink error, it is identified that a tank replacement has been executed and a step S14 changes the ink status to "ink present". Also a step S13 stops the no-ink timer, then the step S14 stops the dot count for ink error and the sequence proceeds to S15.

FIG. 5 is a flow chart showing an ink tank checking operation of the ink jet recording apparatus PR1.

A step S21 initiates an ink tank check. A step S21 returns to S1 in FIG. 4 to execute an ink remain checking operation. Then a step S23 checks whether the ink status is "ink error". If not an "ink error", the sequence proceeds to S30 to clear a reset counter, and then proceeds to S31. In case the ink status is an "ink error", a step S24 checks whether a tank replacement has been made. In case the tank replacement is identified, the sequence proceeds to S30. If not, a step S25 checks whether a resume switch 4*b* has been depressed.

In case the resume switch 4*b* has not been depressed, the sequence returns to S24 to continue the process. In case the resume switch 4*b* has been depressed, a step S26 changes the ink status to "ink low". Then a step S27 resets the dot count for ink error, a step S28 executes an increment +1 of the reset counter, a step S29 starts the no-ink timer, and a step S31 terminates the ink tank check. A timer value set in S29 may be determined from a table in the ROM 2 by referring to the reset count.

The table assigns a timer value for each reset count. For example, a smaller timer value is set for a larger reset count.

Figure 6:
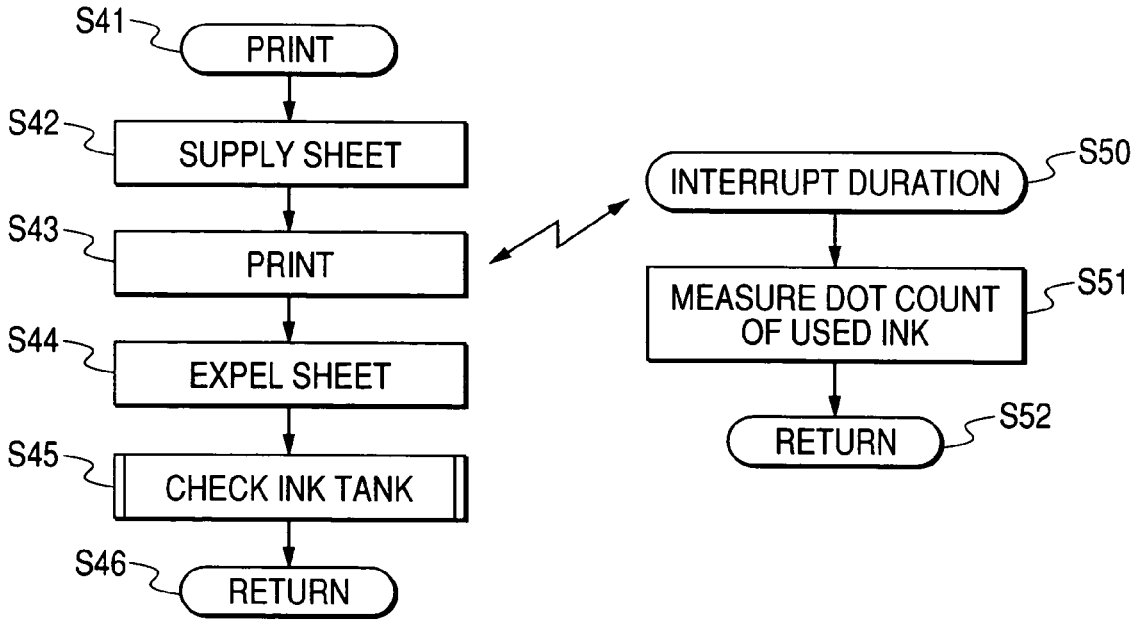
FIG. 6 is a flow chart showing a printing operation in the ink jet recording apparatus PR1.

FIG. 6 is a flow chart showing a printing operation in the ink jet recording apparatus PR1.

A step S41 initiates a printing operation. A step S42 executes a sheet feeding, and S43 executes a printing. In the course of printing, a periodically interrupting handler S50 measures dots of the ink used for printing (S51, S52). Upon completion of the printing in S43, a step S44 executes a sheet discharge, then S45 returns to S1 in FIG. 4 to execute an ink remain checking operation, and a step S46 terminates the printing process.

Figure 7:
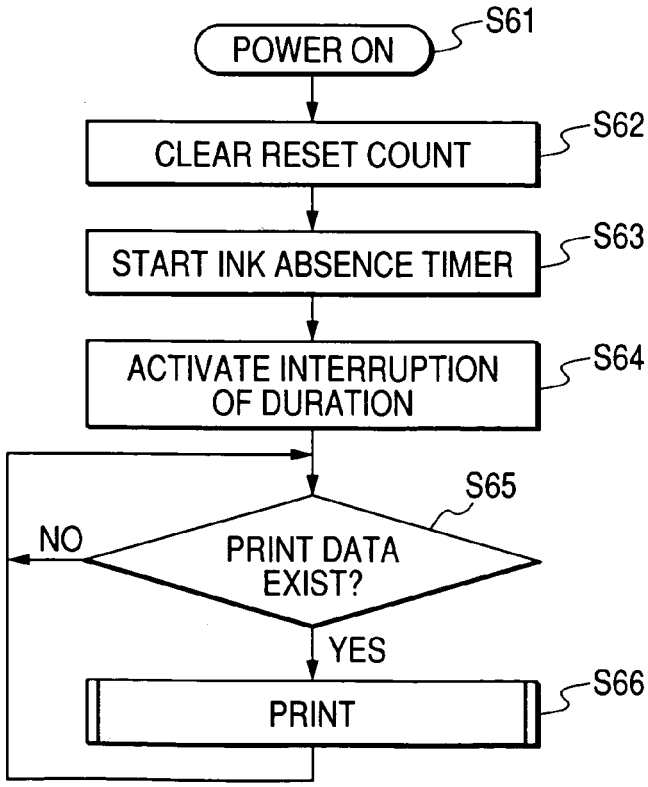
FIG. 7 is a flow chart showing a power-on operation in the ink jet recording apparatus. PR1.

FIG. 7 is a flow chart showing a power-on operation in the ink jet recording apparatus PR1.

A step S61 initiates a power-on procedure. A step S62 clears the reset counter, and S63 starts the no-ink timer. The set timer value may be determined from a table in the ROM 2 by referring to the reset count.

Since the reset counter is 0 in the power-on procedure, a particular value may be set at the top of the table, or the step S63 is so constructed as not to start the timer.

A step S64 activates a periodical handler. Then a step S65 checks whether a print signal has arrived from the interface 20. In case the print signal is not available, the operation of S65 is repeated until the print signal arrives. In case the print signal is available, a step S66 executes the printing, and the sequence returns to S65 for continuing the process.

Second Embodiment

Figure 8:
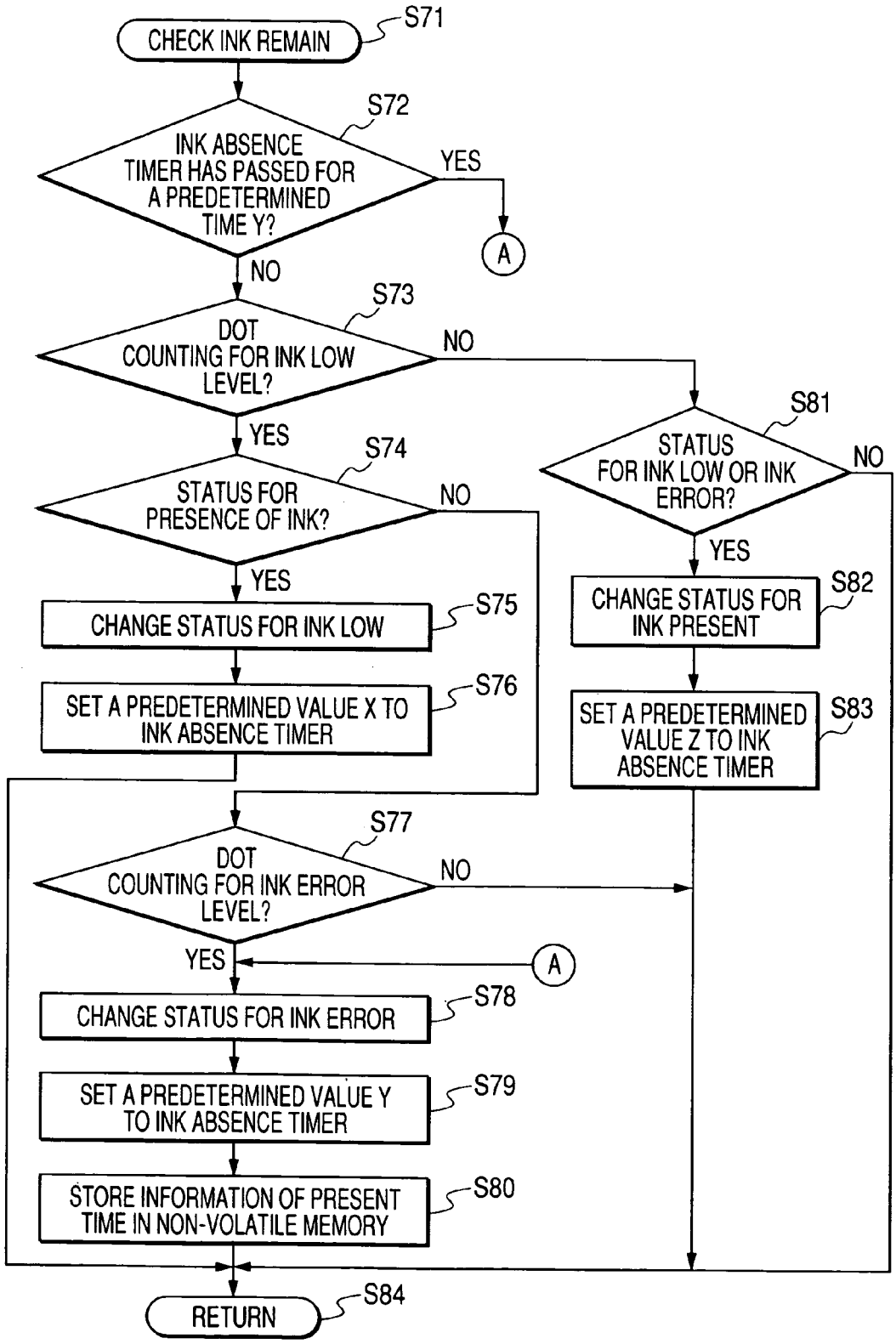
FIG. 8 is a flow chart showing an ink remain checking operation II in a second embodiment of the present invention.

FIG. 8 is a flow chart showing an ink remain checking operation II, constituting a second embodiment of the present invention, and providing a checking method in the absence of the mechanism for detecting the ink remain in the ink tank, in S22 in FIG. 5.

A step S71 initiates an ink remain checking operation. A step S72 checks whether the no-ink timer has passed a predetermined time from the timing of a previous ink error generation. The sequence proceeds to S78 if the predetermined time has elapsed. In case the predetermined time Y has not elapsed, a step S73 checks whether the dot count is in an "ink low" level. If not, the sequence proceeds to S81. In case the "ink low" level has been reached, a step S74 checks the ink status.

In case the ink status is not "ink present", the sequence proceeds to S77. In case the ink status is "ink present", a step S76 sets a predetermined value X in the no-ink timer, and the sequence proceeds to S84.

A step S74 checks the ink status, and, in case the ink status is not "ink present", a step S77 checks whether the dot count has reached an ink error level. In case the ink error level has not been reached, the sequence proceeds to S84. In case the ink error level has been reached, a step S78 changes the ink status to "ink error", and a step S79 sets a predetermined value Y in the no-ink timer. Then a step S10 stores the current time information, namely an ink error generation time information, in a non-volatile memory and executes an error notice and an error display, whereupon the sequence proceeds to S84. The ink error generation time information, stored in the non-volatile memory, is maintained even when the power supply is turned off.

In case the step S73 identifies that the dot count is not in the "ink low" level, S81 checks whether the ink status is "ink low" or an ink error. In case neither state is found, the sequence proceeds to S84 to continue the process. On the other hand, in case the ink status is "ink low" or an ink error, a step S82 changes the ink status to "ink present", and a step S83 sets a predetermined value Z in the no-ink timer, whereupon the sequence proceeds to S84.

This application claims priority from Japanese Patent Application No. 2004-296765 filed on Oct. 8, 2004, which is hereby incorporated by reference herein.

What is claimed is:

1. A recording apparatus capable of recording an image using a recording agent in a container, the apparatus comprising:

an input unit configured to input an instruction from a user;

a first issuing unit configured to issue an error signal for notification of a lack of a recording agent in a container, wherein when the error signal is issued by the first issuing unit, subsequent recording using the recording agent in the container is not performed;

a canceling unit configured to cancel the error signal to allow for subsequent recording based on the instruction input by the input unit;

a checking unit configured to check, in response to subsequent recording being allowed by cancellation of the error signal by the canceling unit, both of (i) whether a first amount of the recording agent in the container is less, by a predetermined amount or greater, than a second amount of the recording agent at a time that the error signal was issued by the first issuing unit; and (ii) whether a predetermined time period has elapsed since subsequent recording was allowed by the cancellation of the error signal by the canceling unit, by causing a timer to count a time period elapsed since the subsequent recording was allowed;

a determining unit configured to (i) determine whether the checking unit has found that the first amount is less, by the predetermined amount or greater, than the second amount, and (ii) determine whether the checking unit has found that the timer has counted the predetermined time period elapsed since the subsequent recording was allowed;

a second issuing unit configured to issue another error signal for notification of a lack of the recording agent in the container when the determining unit determines either (i) or (ii) has been found; and a reset unit configured to reset the time period having been counted by the timer, when the canceling unit cancels the error signal issued by the second issuing unit, whether the canceled error signal was issued based on (i) or (ii).

2. A recording apparatus according to claim 1, wherein the greater a number of cancellations of error signals, the shorter the predetermined time period.

3. A recording apparatus according to claim 1, further comprising an inhibiting unit configured to inhibit recording using the recording agent when the first issuing unit issues the error signal or the second issuing unit issues the another error signal.

4. A recording apparatus according to claim 3, wherein the inhibiting unit inhibits, after recording of a whole page to a recording sheet is completed, recording of a subsequent page.

5. A recording apparatus according to claim 1, wherein the checking unit is further configured to (iii) check an amount of a consumed recording agent in the container after the first issuing unit issues the error signal, and (iv) check whether an amount of the recording agent in the container greater than the predetermined amount has been consumed, according to the determined amount of the consumed recording agent.

6. A recording apparatus according to claim 1, further comprising:

a second determining unit configured to determine an amount of a consumed recording agent in the container, wherein the first issuing unit issues the error signal when the amount determined by the second determining unit is greater than a second predetermined amount.

7. A control method for a recording apparatus capable of recording an image using a recording agent in a container, comprising the steps of:

issuing an error signal for notification of a lack of a recording agent in a container, wherein when the error signal is issued subsequent recording using the recording agent in the container is not performed;

canceling the issued error signal to allow for subsequent recording based on an instruction by a user;

checking, in response to subsequent recording being allowed by cancellation of the error signal, both of:

(i) whether a first amount of the recording agent in the container is less, by a predetermined amount of the recording agent or greater, than a second amount of the recording agent at a time that the error signal was issued, and (ii) whether a predetermined time period has elapsed since subsequent recording was allowed by the cancellation of the error signal, by causing a timer to count a time period elapsed since the subsequent recording was allowed;

determining (i) whether it has been found that the first amount is less, by the predetermined amount or greater, than the second amount, and (ii) whether it has been found that the timer has counted the predetermined time period elapsed since the subsequent recording was allowed; and issuing another error signal for notification of a lack of the recording agent in the container when it is determined that (i) or (ii) has been found; and resetting the time period having been counted by the timer, when the error signal is canceled, whether the canceled error signal was issued based on (i) or (ii).

* * * * *